US005964194A

United States Patent [19]

Pontopiddan et al.

[11] Patent Number: 5,964,194

[45] Date of Patent: Oct. 12, 1999

[54] INLET MANIFOLD WITH RINGED AIR TUBES FOR AN INTERNAL COMBUSTION ENGINE

[75] Inventors: Michaël Pontopiddan, Rueil Malmaison, France; Michèle Sonori, Poggia Renatico, Italy

[73] Assignee: Magneti Marelli France, Nanterre, France

[21] Appl. No.: 08/945,319

[22] PCT Filed: May 20, 1996

[86] PCT No.: PCT/FR96/00750

§ 371 Date: Mar. 2, 1998

§ 102(e) Date: Mar. 2, 1998

[87] PCT Pub. No.: WO96/37696

PCT Pub. Date: Nov. 28, 1996

[30] Foreign Application Priority Data

May 23, 1995 [FR] France ..... 95/06119

[51] Int. Cl.[6] ..... F02M 35/10

[52] U.S. Cl. ..... 123/184.42; 123/184.47

[58] Field of Search ..... 123/184.24, 189.34, 123/184.42, 184.47, 184.53

[56] References Cited

U.S. PATENT DOCUMENTS

| | | | |
|---|---|---|---|
| 4,111,163 | 9/1978 | Ederer et al. | 123/184.42 |
| 5,150,669 | 9/1992 | Rush et al. | 123/184.42 |
| 5,638,784 | 6/1997 | Ohsuga et al. | 123/184.34 |
| 5,651,338 | 7/1997 | Pacheco et al. | 123/184.34 |
| 5,657,727 | 8/1997 | Uchida | 123/184.47 |

FOREIGN PATENT DOCUMENTS

| | | |
|---|---|---|
| 2 453 280 | 4/1980 | France . |
| 32 19 699 | 5/1982 | Germany . |
| 34 39 670 | 10/1984 | Germany . |
| 40 35 016 | 11/1990 | Germany . |
| 2 238 350 | 11/1990 | United Kingdom . |

*Primary Examiner*—Marguerite McMahon
*Attorney, Agent, or Firm*—Henderson & Sturm

[57] ABSTRACT between two half-shells (2, 3) molded and fixed to each other in order to form an envelope (1), there are mounted air tubes (12*a*) with a ringed external face (14) and a smooth interbl face (13) which are fixed by means of end sleeves (17*a*, 18*a*) to the envelope (1). The outlet sleeve (18*a*) is held within a half-shell (3) by means of a fixing clamp (6) to the cylinder-head of the engine by being sealingly connected to an opening (7) of the nozzle comprised of a cradle (29*a*) integrally cast cover (31*a*) fixed to the cradle in prder to hold a seal (28) to the extremity of the outlet sleeve (18*a*), the seal being compressed between the sleeve (18*a*) and the nozzle (29*a*, 31*a*). Application particularly to intake manifolds of internal combustion engines, preferably with controlled ignition.

14 Claims, 1 Drawing Sheet

INLET MANIFOLD WITH RINGED AIR TUBES FOR AN INTERNAL COMBUSTION ENGINE

Figure 1:
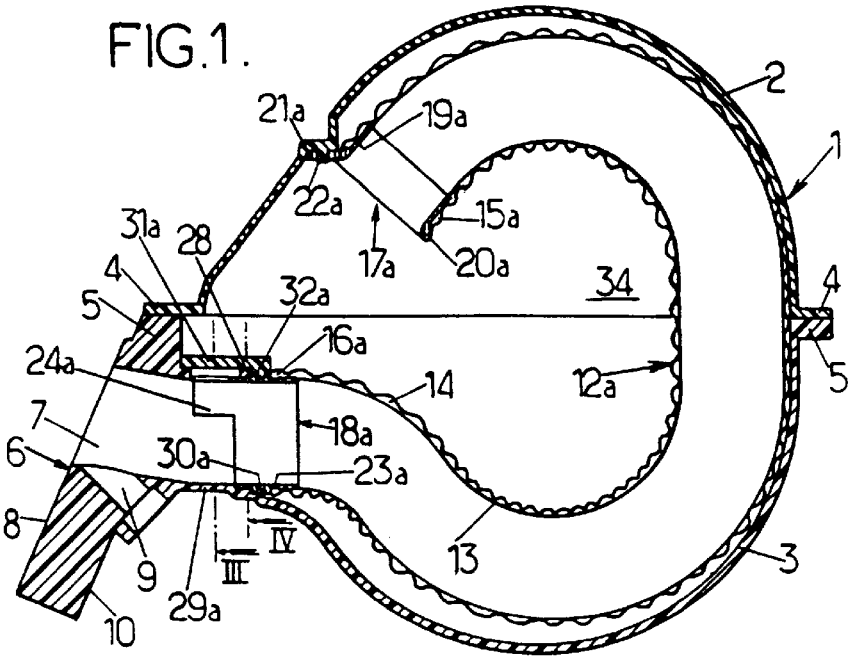

The invention relates to an inlet manifold for an internal combustion engine equipped with a fuel-supply installation preferably by injection, particularly of the so-called "multipoint" type comprising, for each cylinder of the engine, at least one injector which injects fuel into an induction pipe of the inlet manifold that allows air into the engine, directly upstream of the cylinder head of the engine and of the inlet valve or valves of the corresponding cylinder.

More specifically, the invention relates to an inlet manifold of this kind, more particularly intended to be fitted to a controlled-ignition engine and which comprises:

an envelope, delimiting a plenum chamber intended to be supplied with air for supplying the engine, generally by means of a variable-delivery valve such as a butterfly valve, and equipped with at least one flange for attaching it to at least one cylinder head of the engine, the said flange or flanges having at least one opening for supplying each cylinder of the engine, each supply opening opening, on the one hand, into the envelope and, on the other hand, into a face for attaching the flange to the said cylinder head, and curved air-induction tubes, of which there are at least as many as there are cylinders in the engine, and which are mounted in the envelope so that each tube supplies a corresponding cylinder with air which it receives via its inlet in the plenum chamber and which it transmits to a corresponding opening in a flange via its outlet connected by leaktight connecting means to the said supply opening.

The manufacturing of manifolds of this type by molding two half shells of complementary shapes corresponding to the shape of the envelope and which are intended to be secured together via their peripheral edge, along a parting plane, to form the envelope is already known.

The outer part, with respect to the center of curvature of the bent tubes, of the collection of air tubes is formed by the bottoms of cavities molded as hollows in each of the two half shells and which extend one another when the half shells are closed one against the other. Similarly, the inner part of the collection of air tubes is formed by the bottoms of cavities molded as hollows in at least two molded inserts, generally made of the same material as the half shells, for example a moldable synthetic material, preferably a thermoplastic such as polyamide, and which can be filled with reinforcing fibers, each attached to one of the half shells respectively, so that the cavities of the inserts also extend one another when the half shells are secured together. This method therefore makes it possible to form the tubes by the cooperation of surfaces presented by at least four molded parts (two half shells and two inserts) joined together.

A manifold produced in this way is suitable for fitting to a diesel engine, because of the low pressure gradient between the atmosphere and the plenum chamber of the manifold when the engine is running.

By contrast, in a controlled-ignition engine, where this pressure gradient may attain higher mean values, of the order of 70 kPa, when the engine is running, the presence of air leaks between the parts which are assembled to form the air induction tubes, contained inside the plenum chamber has the effect of altering the acoustic impedance of the manifold and thus of lowering the efficiency of the engine.

It is therefore essential for a manifold of this type to be correctly sealed, especially at the air tubes.

For this, a seal needs to be made between the inserts and the half shells by depositing runs of an appropriate polymerizable material, which is a lengthy and tricky operation which combines with the difficulty of producing, to tight tolerances, parts to be assembled to define the air tubes accurately.

The result of this is that a manifold of this kind may become expensive to produce.

The problem underlying the invention is that of proposing a manifold which is economical to produce, essentially made of a thermomoldable synthetic material and semi-modulable because a manifold of this kind can be acoustically matched to an entire family of engines of different cylinder capacities by adjusting the dimensions, particularly the diameter and length of the air tubes.

For this, the inlet manifold according to the invention, of the type outlined hereinabove, is characterized in that each tube is a tube made of a single piece, with a ringed external face, preferably with parallel rings, and a smooth internal face delimiting a central passage with a cross section which is constant in terms of shape and in terms of surface area, so that the tube has great transverse suppleness or flexibility but low axial suppleness or flexibility.

As such one-piece air tubes are, by definition, leaktight, the need to produce runs of sealant along the generatrices disappears. Furthermore, the rings on the ringed external face of such tubes allow the shape and surface area of the cross section of the central passage to be kept constant, this playing a part in preserving the acoustic impedance of the tubes, while giving good flexibility or suppleness in the radial or transverse direction, allowing the tubes to be bent as desired, while their smooth internal surface limits pressure drops and gives the tubes low axial suppleness or flexibility, needed for preserving their acoustic impedance.

Advantageously, each tube is made of a synthetic material, preferably a moldable one, such as a thermoplastic and is cut, at right angles to its longitudinal axis, to the desired length so as to give the manifold an acoustic impedance which is tuned to the engine, from a tubular component that comes as a long length, and preferably has a circular section, so that the tubular component can be obtained for a very reasonable cost compared with the other possible solutions for producing leaktight tubes.

Although the ringed configuration of the external face of the tube can be defined by one or more helical ribs wound around the external face of the tube, from its inlet to its outlet, the ringed external face of each tube is advantageously a cylindrical surface of revolution with a wavy generatrix before the tube is bent into the desired shape, in order simultaneously to benefit from great transverse flexibility but from very low axial flexibility.

The envelope of the manifold may, in the known way, consist of two half shells of complementary shapes corresponding to the shape of the envelope and which are molded, preferably of a moldable synthetic material, preferably thermoplastic, with attachment flanges on their peripheral edges in a parting plane, the half shells being closed and fixed together at their attachment flanges, for example by welding, preferably vibration welding, in which case it is advantageous for each tube to be fixed to the half shells only by its ends.

For this, at least one of the ends of each tube is fixed advantageously to a half shell using a sleeve which is partly force-fitted into the corresponding end of the tube and held on the said half shell by a sleeve part external to the tube. In order to ensure excellent axial retention of the sleeve in the tube, it is advantageous that on the external face of its part that fits into a corresponding end of the tube, the sleeve should have at least one peripheral anchoring tooth which is formed at the axial end pointing toward the said end of the tube with a more or less frustoconical surface with the small base pointing toward the central part of the tube, several teeth offset axially preferably being formed in this way on the sleeve. In addition, the sleeve advantageously has at least one stop projecting more or less radially outward to limit the extent to which it can be pushed into a corresponding end of the tube.

Advantageously, the sleeve or each of the two connecting sleeves of a tube is molded of a synthetic material which is preferably a thermoset.

In a preferred embodiment, for each tube of the manifold, an air inlet sleeve pushed into an inlet end of a tube is shaped, in its part external to the said inlet end of the tube as a bell housing that converges toward the inside of the tube and is equipped with at least one lug for attaching it to that one of the two half shells which does not have the attachment flange with the supply opening to which the said tube is connected by its outlet, attachment being, for example, by thermal welding or snap riveting at the attachment lug or lugs.

Likewise, each tube is advantageously connected by an air outlet sleeve pushed into the outlet end of the tube to that one of the half shells which has the said attachment flange with the said supply opening to which the said tube is connected in leaktight fashion by its outlet, the said leaktight connection means comprising a tubular manifold end piece projecting from the said flange on the opposite side to the cylinder head, in line with the said corresponding supply opening and in which end piece part of the said outlet sleeve, external to the tube, is held with the insertion of at least one flexible seal between the said external part of the outlet sleeve and the said manifold end piece.

Advantageously, to make the constituent parts of the manifold easier to produce and to assemble, each manifold end piece comprises:

a cradle molded as a single piece with the said half shell and the said corresponding attachment flange, and of a more or less semi-cylindrical shape, of which the end internal to the said half shell has a U-shaped bottom forming a stop projecting toward the inside of the cradle, and an attached cover for holding the outlet sleeve and the seal or seals which are mounted on the latter in the cradle, the said cover having a stop projecting toward the inside of the cradle opposite the U-shaped bottom of the cradle and being fixed to the edges of the cradle preferably by ultrasound welding.

Good sealing can be provided using just a single flexible seal for each tube if this seal, mounted around that part of the corresponding outlet sleeve which is external to the tube and held in the corresponding manifold end piece, is molded into a shape, preferably from elastomer, with a cross section that corresponds to that of the space available between, on the one hand, the said outlet sleeve and, on the other hand, the said cradle and the said cover and so that the seal is compressed radially between these three components.

In cases where the cross section of the tube is circular or oval, whereas the cross section of the corresponding supply opening is respectively oval or circular, the corresponding manifold end piece advantageously has a cross section which is more or less the same shape as the said supply opening, and the corresponding outlet sleeve has a central passage which has a cross section of changeable shape, this shape varying progressively from the cross-sectional shape of the manifold end piece, in that part of the outlet sleeve which is external to the tube, to the cross-sectional shape of the tube, in that part of the outlet sleeve which is pushed into the outlet end of this tube, so that the outlet sleeve constitutes an adaptor sleeve allowing for the transition between the cross-sectional shapes of the manifold end piece, and of the air tube.

In addition, in the casing, the tubes may be grouped at least in pairs of tubes that touch over at least part of their length and, in order to limit the transverse displacements of the tubes or groups of touching tubes in the envelope, housings may be delimited by recesses in the internal face of the envelope, and parts of tubes or touching parts of tubes may be housed in these recesses which may be bordered by ribs projecting from the internal face of at least one of the half shells of which the envelope is made.

Figure 3:
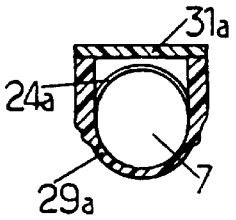
Figure 2:
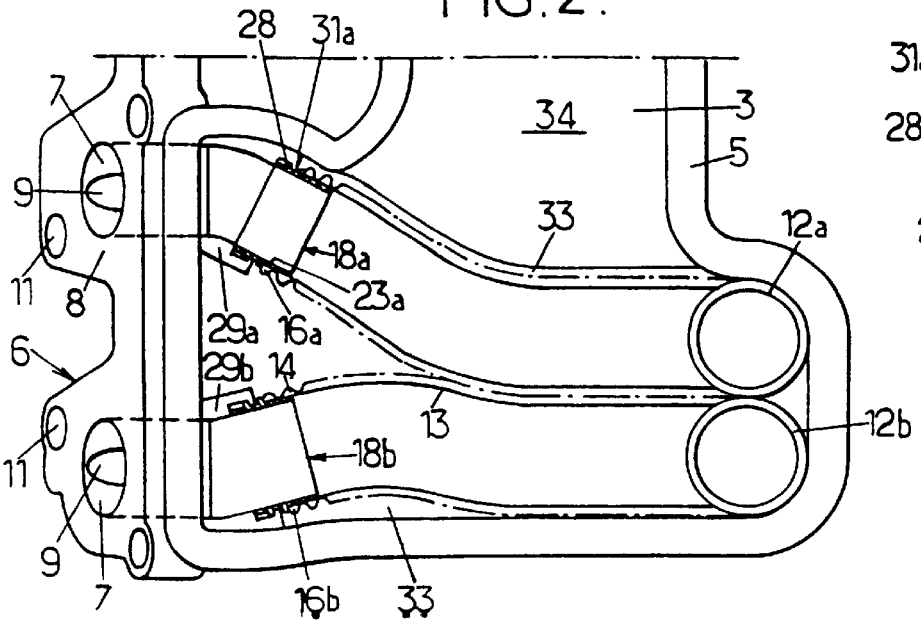
Figure 4:
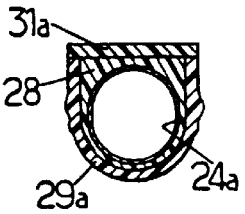
Figure 5:
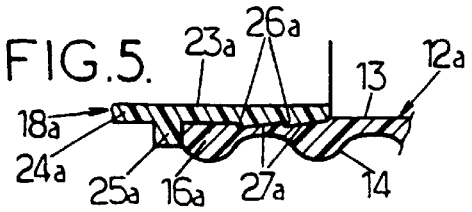

Other features and advantages of the invention will emerge from the description given hereinbelow without implied limitation of some embodiments which are described with reference to the appended drawings in which:

FIG. 1 is a view in cross section of a manifold for an engine with four in-line cylinders, the section being taken more or less at right angles to the axis of the engine, FIG. 2 is a half view partly in plan and partly in section of the downstream half shell of the manifold of FIG. 1, with one of the two pairs of tubes which are grouped together and held in this half shell by their outlet end, FIGS. 3 and 4 are cross-sections on III—III and IV—IV of FIG. 1, respectively, and FIG. 5 is a partial view in axial section and to a larger scale of a detail of FIG. 2.

The manifold in FIGS. 1 and 2, for an engine with four in-line cylinders, comprises a rigid envelope 1, made of moldable and thermally weldable synthetic material such as a polyamide which may be reinforced with reinforcing fibers, and which consists of two half shells 2 and 3, each molded from this material, having complementary shapes which correspond to the shape of the envelope 1. The two half shells 2 and 3 close up on each other, via their peripheral edges, to reconstitute the shape of the envelope 1, and are secured together along a parting plane P defined by attachment flanges 4 and 5 which project outward from their edges, by vibration welding at these flanges 4 and 5 after four air-induction tubes (one per cylinder of the engine) grouped into two pairs of touching tubes as depicted in FIG. 2, and their sleeves as described hereinbelow, have been mounted in the half shells 2 and 3.

The flange 5 of the half-shell 3, which faces the flange 4 of the half shell 2 over the entire periphery of the half shells is supported, on one side of the envelope 1, by the upper part of a flange 6 for attaching the anifold to the cylinder head of the engine, this flange 6 being molded as a single piece with the half shell 3 and its peripheral flange 5. For each cylinder of the engine, the flange 6 has a supply opening 7, formed integrally by molding, with a circular or oval cross-section, which opens on one side into the flat face 8 for attaching the flange 6 to the cylinder head of the engine and, on the other side, into the half shell 3 which is the lower half shell in FIG. 1 and known as the downstream half shell because it is intended to house the downstream parts of the air tubes, as opposed to the half shell 2 which is the upper half shell in FIG. 1 and known as the upstream half shell because it is intended to house the upstream parts of the air tubes. For each cylinder, the flange 6 also has a housing 9 for a fuel injector, this housing 9 opening into the face 10 of the flange 6 which is the opposite face to the face 8 for attaching to the cylinder head, and on the outside of the half shell 3, on the one hand and, on the other hand, each housing 9 opens into a corresponding supply opening 7. Finally, the flange 6 has holes 11, also formed integrally by molding like the openings 7 and the housings 9, for the passage of members for attaching the manifold to the cylinder head.

The manifold also comprises a bent air-induction tube for each cylinder, namely, as already stated, four air tubes grouped into two pairs of tubes that touch over a part of their length.

Each tube, such as 12*a* or 12*b* of the pair of tubes in FIG. 2 is a bent tube obtained by cutting, at right angles to its longitudinal axis, a given length so as to give the tube 12*a* or 12*b* an acoustic impedance that is tuned to the engine, from a long thermoplastic tube which has a smooth internal face 13 delimiting a central passage with a cross section of constant shape and constant surface area, which is for example circular, and a ringed external face 14, with peripheral rings in planes more or less parallel to each other and perpendicular to the axis of the tube before the cut length of tube is bent into the desired shape by closing the half shells 2 and 3, to each of which each tube 12*a* or 12*b* is attached merely by a respective one of its inlet ends such as 15*a* and outlet ends 16*a* or 16*b*. In this way a tube 12*a* or 12*b* is produced which is lightweight, thin-walled and leaktight and which has great transverse or radial suppleness or flexibility, and low axial suppleness or flexibility, so that it can be bent into the desired shape without losing the constant shape and constant surface area of the cross-section of its smooth-walled central passage and without an appreciable variation in its length, and this ensures pressure drops and an acoustic impedance which are practically constant. Each tube such as 12*a* or 12*b* is bent into an almost complete loop in the plane of FIG. 1, over most of its length more or less starting from its inlet such as 15*a*, and its downstream part is additionally bent or bent back in a direction perpendicular to the plane of FIG. 1, as depicted in FIG. 2. Thanks to their bent shapes, two tubes such as 12*a* and 12*b*, grouped into a pair of tubes each to supply one of two adjacent cylinders respectively, can touch over a long part of their length more or less starting from their inlets such as 15*a*, while their outlets 16*a* and 16*b* (see FIG. 2) are spaced apart so that each can be connected in leaktight fashion to a respective one of two supply openings 7 next to one another in the flange 8 in order to supply the corresponding two neighboring cylinders.

The inlet end such as 15*a* of each tube 12*a* or 12*b* is attached to the upstream half shell 2 by an air inlet sleeve such as 17*a*, while the outlet end 16*a* or 16*b* of the tube is connected to the downstream half shell 3 by an air outlet sleeve 18*a* or 18*b*, each of the sleeves 17*a*, 18*a* or 18*b* preferably being molded from a synthetic material, preferably a thermoset.

The inlet sleeve 17*a* comprises a tubular part 19*a* which is force-fitted into the inlet end 15*a* of the tube 12*a* and which is extended forward, on the outside of this inlet 15*a*, by a part which is shaped like an inlet bell housing or tulip 20*a* converging toward the inside of the tube 12*a* and in the downstream direction. This inlet bell mouth 20*a* has an attachment lug 21*a* via which the sleeve 17*a* is attached to the half shell 2 at least at one point, for example by thermal welding or by a snap rivet, as represented diagrammatically at 22*a*. To reduce pressure drops, the internal face of the tubular part 19*a* is smooth and more or less in line with the smooth internal face 13 of the tube 12*a*, whereas to ensure that the sleeve 17*a* is pushed correctly axially into the inlet 15*a* of the tube 12*a*, the external face of the tubular part 19*a* has peripheral teeth, as described hereinbelow for the outlet sleeve 18*a* with reference to FIG. 5.

Each outlet sleeve 18*a* or 18*b* comprises, as depicted in respect of the sleeve 18*a* in FIG. 5, a tubular part 23*a* which is force-fitted into the outlet 16*a* of the tube 12*a* and which is extended backward or in the downstream direction, on the outside of this outlet 16*a*, by a tubular part 24*a* external to the tube 12*a* and held on the half shell 3 by being connected in leaktight fashion to the corresponding opening 7 in the way described hereinbelow. The parts 23*a* and 24*a* between which the sleeve 18*a* has an annular stop 25*a* projecting radially outward to limit the extent to which it is pushed into the outlet 16*a* of the tube 12*a* have a smooth internal face more or less in line with the smooth internal face 13 of the tube 12*a*, whereas the external face of the pushed-in part 23*a* has two peripheral and axially offset teeth 26*a*, each formed at that axial end which points toward the stop 25*a*, of a more or less frustoconical surface 27*a* with a small base pointing toward the end of the part 23*a* furthest inside the tube 12*a*, so as to make pushing-in easier and give good anchorage.

A flexible and annular seal 28 molded from elastomer with the cross-sectional shape depicted in FIG. 4 is mounted around the external part 24*a* of the sleeve 18*a*, and this external part 24*a* surrounded by the seal 28 is introduced into a cradle 29*a*, molded as a single piece with the half shell 3 and the flange 6. This cradle 29*a* projects from the flange 6 on the opposite side to the cylinder head of the engine and is roughly in the shape of a half-cylinder open toward the parting plane P, with a U-shaped cross-section of substantially constant surface area delimiting a central duct which extends a corresponding opening 7 toward the inside of the half shell 3. At its end in the half shell 3, the cradle 29*a* has an annular chamber delimited by a U-shaped bottom 30*a* projecting radially toward the inside of the cradle 29*a* to form a stop that prevents the seal 28 from coming axially out of the external part 24*a* of the sleeve 18*a*. When the external part 24*a* is fitted into the cradle 29*a* in this way, the seal 28 around the sleeve 18*a* is compressed radially between the sleeve 18*a* and the cradle 29*a*. The retention of the part 24*a* of the sleeve 18*a* in the cradle 29*a* of the half shell 3 and its leaktight connection with the corresponding opening 7, by virtue of the seal 28, are supplemented by a flat cover 31*a* attached transversely to that part 24*a* of the sleeve 18*a* which is engaged in the cradle 29*a*, and bearing via its periphery against the edges of this cradle 29*a*, the cover 31*a* having an edge 32*a* in the form of a stop shaped as an arc of a circle projecting toward the inside of the cradle 29*a*, and facing the U-shaped bottom 30*a* of the latter so that the edge 32*a* and the U-shaped bottom 30*a* together form an annular stop. This cover 31*a* is molded of synthetic material, preferably thermoplastic, and preferably welded by ultrasound round its periphery to the edges of the cradle 29*a*. The sleeve 18*a* is thus held and leaktightness of its connection with the corresponding opening 7 is thus ensured by means of the seal 28 and of a tubular manifold end piece formed by the cradle 29*a* and the corresponding cover 31*a*. As shown in the sectional view of FIG. 4, the seal 28 is molded with a cross-sectional shape such that it radially occupies all the space available between the part 24*a* of the sleeve 18*a*, at the center, and the cradle 29*a* and the cover 31*a* at the periphery, being compressed radially between these components. Beyond the seal 28 and toward the opening 7, the part 24*a* of the sleeve 18*a* is extended by an end in the shape of a half cylinder open toward the bottom of the cradle 29*a* that accommodates it and having, as shown in the sectional view of FIG. 3, a recess that complements that of the cradle 29*a* to define a duct of progressively varying cross section connecting the outlet, which for example is circular, 16*a* of the tube 12*a* to the cross section, which for example is oval, of the corresponding opening 7, as depicted in the drawings. The outlet sleeve 18*a* is molded in such a way that its central passage has this corresponding change in cross-section, the cross-section of that end of the sleeve 18*a* that is pushed into the tube 12*a* always having the same shape as the cross section of the tube 12*a*, and the cross-section of that end of the sleeve 18*a* that points toward the opening 7 having, in itself or combined with the complementary cross-section of the bottom of the cradle 29*a* that accommodates it, the same shape as the cross-section of the opening 7.

The outlet sleeve 18*b* of the tube 12*b* is mounted in the same way, with a seal such as 28 in a manifold end piece that consists of a similar cradle 29*b* closed by a corresponding similar cover.

To limit their transverse displacements, the two tubes 12*a* and 12*b* are also arranged, via their touching parts, in a housing delimited in the downstream half shell 3 by a recess between ribs 33 projecting from the internal face of this half shell 3.

The tubes 12*a* and 12*b* may touch in such a way that the rings of the external face of one fit between the rings of the other and, as an option, the ribs 33 bordering the housings may have projections that fit between the external rings of the tubes 12*a*, 12*b* in order better to position them in the envelope 1.

As the transversely supple tubes 12*a* and 12*b* are attached to the envelope 1 just by their ends, the sleeves 17*a* and 18*a* are mounted in such a way as to give the tubes an overall radius of curvature which is slightly smaller than the radius of curvature of the rounded parts of the half shells 2 and 3 of the envelope 1.

The transverse suppleness of the tubes allows for small alternating relative displacements of the half shells 2 and 3 as the latter are being assembled, in the direction perpendicular to the radius of curvature of the tubes, thus offering the possibility of assembling the half shells 2 and 3 by vibration welding for example.

This thus yields a manifold in which the envelope 1 delimits an internal chamber 34 known as a plenum chamber which is supplied with air for supplying the engine via an opening (not depicted) for example formed in an end face of the envelope 1 parallel to the plane of FIG. 1, this opening being connected to a butterfly valve. Each tube such as 12*a* or 12*b* mounted in the envelope 1 draws air into the plenum chamber 34 via its inlet such as 15*a* and transmits this air via its outlet 16*a* or 16*b* to a supply opening 7 in the flange 6 in order to supply a corresponding cylinder. It will be understood that the envelope 1, in its half that is not depicted in FIG. 2, contains two more air-induction tubes which are symmetric with the tubes 12*a* and 12*b* and mounted in the same way.

We claim:

1. An inlet manifold for an internal combustion engine; said inlet manifold comprising:

an envelope, delimiting a plenum chamber for supplying air to an engine, and equipped with at least one flange for attaching said plenum chamber to at least one cylinder head of the engine, said at least one flange having at least one supply opening for supplying at least one cylinder of the engine, said at least one supply opening opening, on the one hand, into said envelope and, on the other hand, into a face for attaching said at least one flange to said at least one cylinder head, and at least one curved, one-piece, air-induction tube corresponding in number to said at least one cylinder of the engine, and mounted in said envelope so that each said at least one curved air-induction tube supplies a corresponding said at least one cylinder with air via an inlet in said plenum chamber and transmits air to a corresponding one of said at least one supply opening in said at least one flange via an outlet connected by leaktight connection means for connecting to said at least one supply opening, wherein each said at least one curved air-induction tube comprises a tube member with a ringed external face and a smooth internal face delimiting a central passage with a cross section which is substantially constant in shape and surface area, wherein said at least one curved air-induction tube has great transverse suppleness or flexibility but low axial suppleness or flexibility.

2. An inlet manifold according to claim 1, wherein each said at least one curved air-induction tube comprises a synthetic material.

3. An inlet manifold according to claim 1, wherein said envelope comprises two molded half shells, of complementary shapes corresponding to a shape of said envelope said half shells having attachment flanges on peripheral edges in a parting plane, said half shells being closed and fixed together at said attachment flanges, and wherein each said at least one curved, one-piece, air-induction tube is fixed to said half shells by at least one tube end.

4. An inlet manifold according to claim 1, wherein in said envelope, said at least one curved, one-piece, air-induction tube comprise a plurality of tubes grouped as groups of at least pairs of touching tubes that touch over at least part of their length, and wherein transverse displacements of the groups of touching tubes in said envelope are limited by recesses in an internal face of the envelope, wherein said touching parts of the touching tubes are disposed in said recesses.

5. An inlet manifold for an internal combustion engine; said inlet manifold comprising:

an envelope, delimiting a plenum chamber for supplying air to an engine, and equipped with at least one flange for attaching said plenum chamber to at least one cylinder head of the engine, said at least one flange having at least one supply opening for supplying at least one cylinder of the engine, said at least one supply opening opening, on the one hand, into said envelope and, on the other hand, into a face for attaching said at least one flange to said at least one cylinder head;

at least one curved, one-piece, air-induction tube corresponding in number to said at least one cylinder of the engine, and mounted in said envelope so that each said at least one curved air-induction tube supplies a corresponding said at least one cylinder with air via an inlet in said plenum chamber and transmits air to a corresponding one of said at least one supply opening in said at least one flange via an outlet connected by leaktight connection means for connecting to said at least one supply opening, wherein each said at least one curved air-induction tube comprises a tube member with a ringed external face and a smooth internal face delimiting a central passage with a cross section which is substantially constant in shape and surface area, wherein said at least one curved air-induction tube has great transverse suppleness or flexibility but low axial suppleness or flexibility; and wherein said ringed external face of each said at least one curved air-induction tube comprises a cylindrical surface of revolution with a wavy generatrix before the tube member is bent into a desired shape.

6. An inlet manifold for an internal combustion engine; said inlet manifold comprising:

an envelope, delimiting a plenum chamber for supplying air to an engine, and equipped with at least one flange for attaching said plenum chamber to at least one cylinder head of the engine, said at least one flange having at least one supply opening for supplying at least one cylinder of the engine, said at least one supply opening opening, on the one hand, into said envelope and, on the other hand, into a face for attaching said at least one flange to said at least one cylinder head;

at least one curved, one-piece, air-induction tube corresponding in number to said at least one cylinder of the engine, and mounted in said envelope so that each said at least one curved air-induction tube supplies a corresponding said at least one cylinder with air via an inlet in said plenum chamber and transmits air to a corresponding one of said at least one supply opening in said at least one flange via an outlet connected by leaktight connection means for connecting to said at least one supply opening, wherein each said at least one curved air-induction tube comprises a tube member with a ringed external face and a smooth internal face delimiting a central passage with a cross section which is substantially constant in shape and surface area, wherein said at least one curved air-induction tube has great transverse suppleness or flexibility but low axial suppleness or flexibility;

wherein said envelope comprises two molded half shells, of complementary shapes corresponding to a shape of said envelope said half shells having attachment flanges on peripheral edges in a parting plane, said half shells being closed and fixed together at said attachment flanges, and wherein each said at least one curved, one-piece, air-induction tube is fixed to said half shells by at least one tube end; and wherein said at least one tube end of each said at least one curved, one-piece, air-induction tube is fixed to a half shell using a sleeve which is partly force-fitted into a corresponding said at least one tube end of said at least one curved, one-piece, air-induction tube and held on said half shell by a sleeve part external to said at least one curved, one-piece, air-induction tube.

7. An inlet manifold according to claim 6, wherein on an external face of a part that is pushed into a corresponding end of an at least one curved, one-piece, air-induction tube, said sleeve has at least one peripheral anchoring tooth formed at an axial end pointing toward said corresponding said at least one tube end of said at least one curved, one-piece, air-induction tube, with a generally frustoconical surface with a small base pointing toward a central part of said at least one curved, one-piece, air-induction tube.

8. An inlet manifold according to claim 5, wherein said sleeve has at least one stop projecting generally radially outward to limit an extent to which said sleeve can be pushed into a corresponding at least one tube end of said at least one curved, one-piece, air-induction tube.

9. An inlet manifold according to claim 6, wherein said sleeve comprises molded synthetic material.

10. An inlet manifold according to claim 5, wherein at least one air inlet sleeve pushed into an inlet end of a said at least one curved, one-piece, air-induction tube is shaped, in a part external to said inlet end of said at least one curved, one-piece, air-induction tube as a bell housing that converges toward an inside of said at least one curved, one-piece, air-induction tube, and is equipped with at least one lug for attaching to one of the two half shells which does not have said at least one flange with said at least one supply opening to which said at least one curved, one-piece, air-induction tube is connected by its outlet.

11. An inlet manifold according to claim 6, wherein each said at least one curved, one-piece, air-induction tube is connected by an air outlet sleeve pushed into said outlet of said at least one curved, one-piece, air-induction tube to one of the half shells which has said at least one flange with a supply opening to which said at least one curved, one-piece, air-induction tube is connected by a leaktight connection means for connecting in leaktight fashion by its outlet, said leaktight connection means comprising a tubular manifold end piece projecting from said at least one flange on said corresponding one of said at least one supply opening and in which end piece part of said outlet sleeve, external to said at least one curved, one-piece, air-induction tube, is held with an insertion of at least one flexible seal between said external part of said outlet sleeve and said manifold end piece.

12. An inlet manifold according to claim 11, wherein said manifold end piece comprises:

a cradle molded as a single piece with a said half shell and a corresponding at least one flange, and having a generally semi-cylindrical shape, of which an end internal to said half shell has a generally U-shaped bottom forming a stop projecting toward an inside of the cradle, and an attached cover for holding said outlet sleeve and said at least one flexible seal which is mounted on said sleeve in the cradle, said cover having a stop projecting toward an inside of the cradle opposite the generally U-shaped bottom of the cradle and being fixed to edges of the cradle.

13. An inlet manifold according to claim 12, comprising, for each said at least one curved, one-piece, air-induction tube, a single said at least one flexible seal mounted around a part of a corresponding outlet sleeve which is external to said at least one curved, one-piece, air-induction tube and held in a corresponding manifold end piece and molded into a shape, with a cross section that corresponds to a cross section of a space available between a plurality of components selected from the group consisting of said outlet sleeve, said cradle, and said attached cover so that said single at least one flexible seal is compressed radially between said components.

14. An inlet manifold according to claim 11, wherein each said manifold end piece has a cross section comprising a substantially same shape as a shape of a corresponding said at least one supply opening and wherein a corresponding outlet sleeve has a central passage which has a cross section of changeable shape, said changeable shape varying progressively from a cross-sectional shape of a said manifold end piece, in that part of the outlet sleeve which is external to said at least one curved, one-piece, air-induction tube, to a cross-sectional shape of said at least one curved, one-piece, air-induction tube, in that part of the outlet sleeve which is pushed into the outlet of said at least one curved, one-piece, air-induction tube.

* * * * *